US008025336B2

(12) United States Patent
Hanus

(10) Patent No.: US 8,025,336 B2
(45) Date of Patent: Sep. 27, 2011

(54) DENTAL CHAIR

(75) Inventor: Leo R. Hanus, Tipp City, OH (US)

(73) Assignee: Midmark Corporation, Versailles, OH (US)

( * ) Notice: Subject to any disclaimer, the term of this patent is extended or adjusted under 35 U.S.C. 154(b) by 0 days.

(21) Appl. No.: 12/262,887

(22) Filed: Oct. 31, 2008

(65) Prior Publication Data

US 2010/0109405 A1 May 6, 2010

(51) Int. Cl.
*A47C 1/06* (2006.01)

(52) U.S. Cl. ..... 297/344.16

(58) Field of Classification Search ..... 297/344.14, 297/344.16, 344.17, 344.19
See application file for complete search history.

(56) References Cited

U.S. PATENT DOCUMENTS

| | | | | | |
|---|---|---|---|---|---|
| 3,302,971 | A | * | 2/1967 | Lory | 297/344.14 |
| 3,514,153 | A | * | 5/1970 | Ferguson et al. | 297/71 |
| 3,554,598 | A | * | 1/1971 | Dunkin | 297/330 |
| 3,596,982 | A | * | 8/1971 | Grams | 297/71 |
| 3,596,991 | A | * | 8/1971 | Mckee et al. | 297/286 |
| 3,823,979 | A | | 7/1974 | Davis, Sr. | |
| 3,984,146 | A | | 10/1976 | Krestel et al. | |
| 4,211,451 | A | | 7/1980 | Shephard | |
| 4,516,805 | A | | 5/1985 | Leeper et al. | |
| 4,552,403 | A | | 11/1985 | Yindra | |
| 4,711,486 | A | * | 12/1987 | Fujiyama | 297/71 |
| 4,761,000 | A | | 8/1988 | Fisher et al. | |
| 5,015,035 | A | * | 5/1991 | Stoeckl et al. | 297/344.17 |
| 5,131,717 | A | | 7/1992 | Kaminiski et al. | |
| 5,190,349 | A | * | 3/1993 | Austin et al. | 297/316 |
| D378,961 | S | * | 4/1997 | Nordstrom et al. | D6/367 |
| D565,315 | S | * | 4/2008 | Nielsen | D6/367 |
| 2002/0148044 | A1 | | 10/2002 | Hayes et al. | |
| 2003/0071503 | A1 | | 4/2003 | Brockway et al. | |
| 2005/0156453 | A1 | | 7/2005 | Lin | |

OTHER PUBLICATIONS

U.S. Patent and Trademark Office; Search Report and Written Opinion in International Patent Application No. PCT/US2009/052066 dated Sep. 3, 2009.

US Patent and Trademark Office; Search Report and Written Opinion in International Patent Application No. PCT/US2009/052096 dated Sep. 15, 2009.

US Patent and Trademark Office; Search Report and Written Opinion in International Patent Application No. PCT/US2009/052104 dated Sep. 15, 2009.

* cited by examiner

*Primary Examiner* — Anthony Barfield
(74) *Attorney, Agent, or Firm* — Wood, Herron & Evans, LLP

(57) ABSTRACT

A dental chair for supporting a patient during examination and the performance of procedures on the patient includes a patient support having a seat and a back, a base adapted to engage a floor surface, and a lift arm. The lift arm has a first end pivotally coupled to support structure at a first, terminal end of the base for rotation about a pivot axis defined by the support structure. A second end of the lift arm is coupled to the patient support.

4 Claims, 7 Drawing Sheets

DENTAL CHAIR

CROSS-REFERENCE TO RELATED APPLICATIONS

This application is related to the following U.S. patent applications, each assigned to the Assignee of the present application:

U.S. patent application Ser. No. 12/262,966, filed Oct. 31, 2008;

U.S. patent application Ser. No. 12/262,995, filed Oct. 31, 2008;

U.S. Design application Ser. No. 29/327,186, filed Oct. 31, 2008; and

U.S. Design application Ser. No. 29/327,189, filed Oct. 31, 2008.

TECHNICAL FIELD

The present invention relates to apparatus for supporting persons during examination or the performance of a dental or medical procedure, and more particularly to a dental chair having an improved lift assembly.

BACKGROUND

Conventional dental operatories generally include an articulating dental chair for supporting a patient in a variety of positions to facilitate the performance of dental procedures and operations. For example, dental chairs are generally adapted to be raised and lowered relative to a floor surface, and to be moved between a first orientation where a seat back is inclined relative to a seat base to support the patient in a seated position, and a second orientation where the seat back is reclined to support the patient in a generally supine position.

The dental operatory may also include a dental delivery unit adapted to support various instruments and tools used during the performance of dental procedures. The delivery unit is typically provided with water and pressurized air for operating the instruments, and may include a tray for supporting instruments or other articles used by the practitioner. The delivery unit may be supported on a movable arm that facilitates positioning the unit and instruments adjacent the dental chair for convenient access by the practitioner during the performance of a procedure, then moved away to permit the patient to exit the dental chair when the procedure is complete.

Conventional dental operatories may further include a cuspidor provided adjacent the dental chair to permit patients to expel the contents of their mouths during or at the conclusion of the dental procedure, an adjustably positionable lamphead to illuminate the treatment area, and various other devices useful for the performance of dental procedures. Such devices may be supported on cabinetry or other structure positioned adjacent the dental chair for convenient access by the patient or the dental practitioner.

A dental chair should generally be movable from a lowered position with the seat back inclined, which facilitates entry and exit from the chair, and a raised position with the seat back reclined, which facilitates examination and the performance of procedures by a dental practitioner. Conventional dental chairs use a lift arm pivotally coupled to a base at a position intermediate the front and rear ends of the base to raise and lower the chair. This configuration generally results in a bulky base structure that has a rather large footprint, making it difficult for a dental practitioner to navigate around the chair during the performance of procedures. This configuration also limits the maximum length of the lift arm. In general, a longer lift arm is more desirable because it provides a greater vertical rise of the chair while minimizing fore and aft movement of the chair during raising and lowering.

Accordingly, there is a need for an improved dental chair which overcomes these and other drawbacks of prior art dental chairs.

SUMMARY

The present invention overcomes the foregoing and other shortcomings and drawbacks of dental chairs heretofore known for supporting a patient during examination and the performance of procedures. While the invention will be described in connection with certain embodiments, it will be understood that the invention is not limited to these embodiments. On the contrary, the invention includes all alternatives, modifications and equivalents as may be included within the spirit and scope of the present invention.

In one aspect, a dental chair for supporting a patient during examination and the performance of procedures on the patient includes a patient support having a seat and a back, a base adapted to engage a floor surface, and a lift arm. The lift arm has a first end pivotally coupled to support structure at a first, terminal end of the base for rotation about a pivot axis defined by the support structure. A second end of the lift arm is coupled to the patient support.

In another aspect, an actuator is coupled between the base and the lift arm for moving the lift arm for rotation about the pivot axis to thereby raise and lower the patient support. The actuator is offset from a longitudinal centerline of the lift arm and in a direction toward one if the lateral sides of the lift arm. The actuator may be a hydraulic cylinder having a pump in fluid communication with the hydraulic cylinder. In another aspect, the pump is positioned behind the pivot axis and in a direction away from the first terminal end of the base.

In another aspect, the examination and treatment chair further includes a load-bearing panel coupled to the lift arm and fastened at least at the first and second sides of the lift arm. The load-bearing panel helps to resist twisting of the lift arm resulting from uneven loading of the lift arm by the patient support and the offset actuator.

These and other features, objects and advantages of the invention will become more readily apparent to those skilled in the art in view of the following detailed description, taken in conjunction with the accompanying drawings.

BRIEF DESCRIPTION OF THE FIGURES

The accompanying drawings, which are incorporated in and constitute a part of this specification, illustrate exemplary embodiments of the invention and, together with a general description of the invention given above, and the detailed description given below, serve to explain the invention in sufficient detail to enable one of ordinary skill in the art to which the invention pertains to make and use the invention.

DETAILED DESCRIPTION

Figure 1:
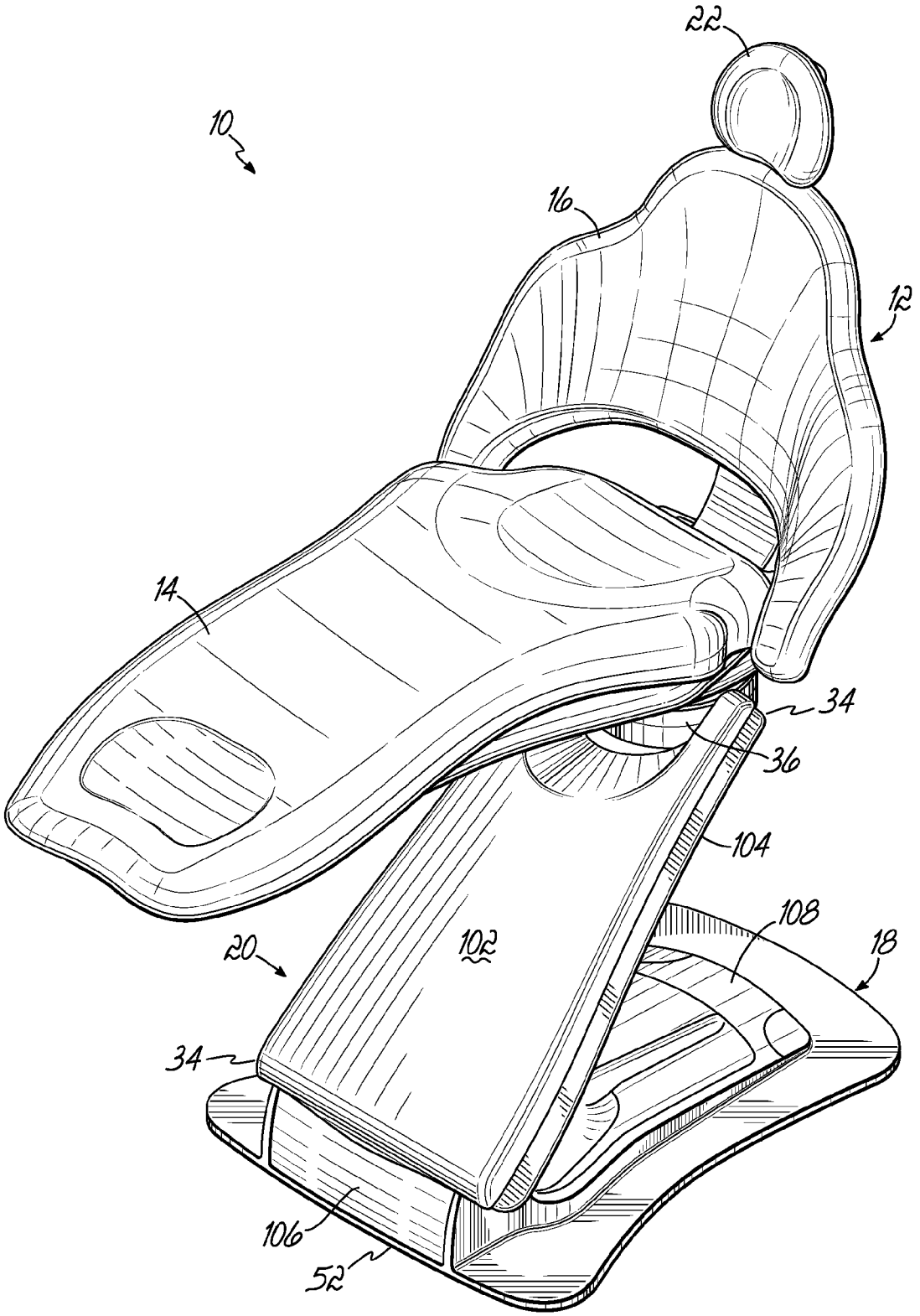
FIG. 1 is a perspective view of an exemplary dental chair in accordance with the principles of the present disclosure.
Figure 2A:
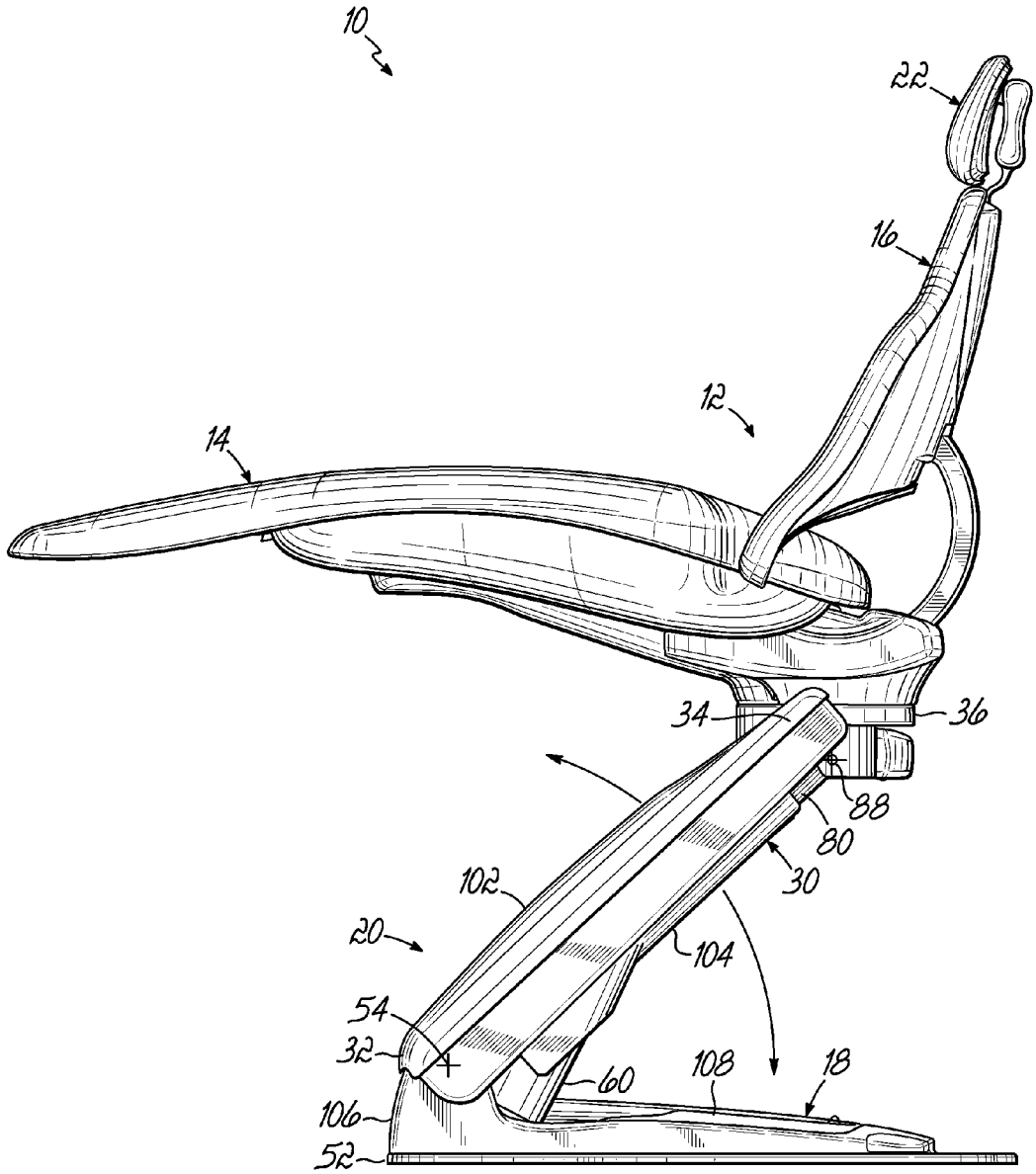
FIG. 2A is a side elevation view of the dental chair of FIG. 1, in a raised position.
Figure 2B:
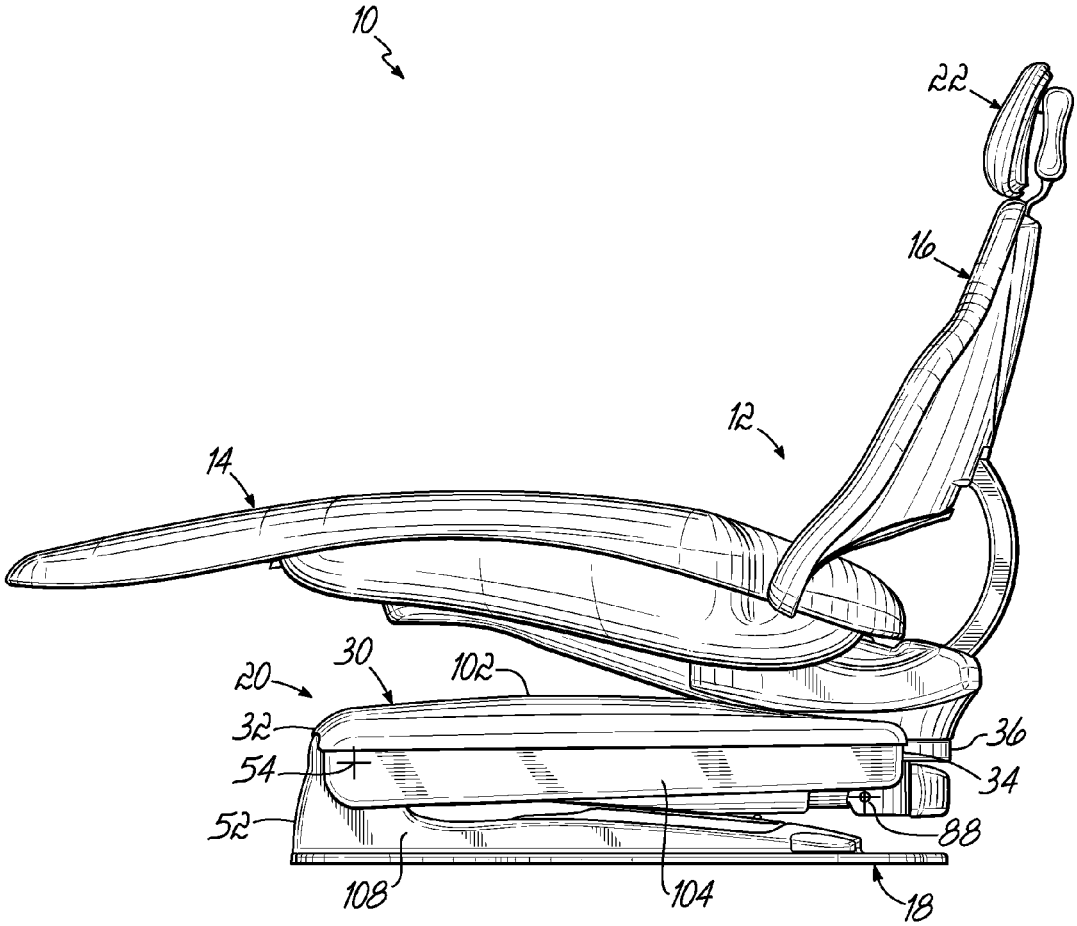
FIG. 2B is a side elevation view of the dental chair of FIG. 1, in a lowered position.

FIG. 1 depicts an exemplary dental chair 10 in accordance with the principles of the present disclosure. The dental chair 10 comprises a patient support 12 including a seat section 14 and a back section 16 that is movable relative to the seat section 14 from a generally inclined position that facilitates maintaining a patient in a seated position, and a generally reclined position that supports a patient in a supine position. The dental chair 10 further includes a base 18 and a lift assembly 20 coupled to the base 18 for moving the patient support 12 from a raised position, as depicted in FIGS. 1 and 2A, to a lowered position, as depicted in 2B. The dental chair 10 may further include a headrest 22 coupled to the back section 16 of the patient support 12 to facilitate supporting a patient's head while the patient is in the chair 10.

Figure 3A:
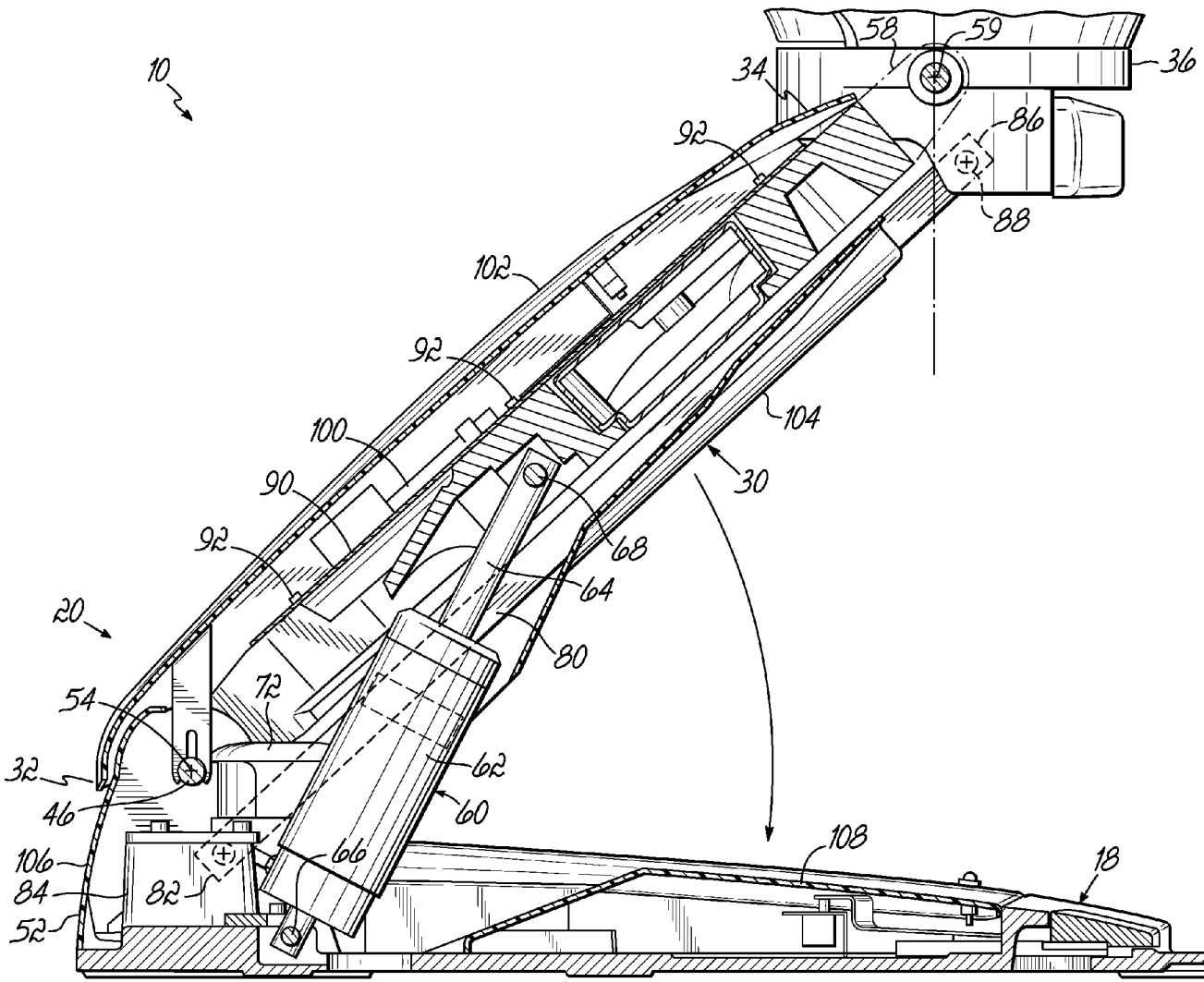
FIG. 3A is a partial cross-sectional view of the dental chair of FIG. 1, in a raised position.
Figure 3B:
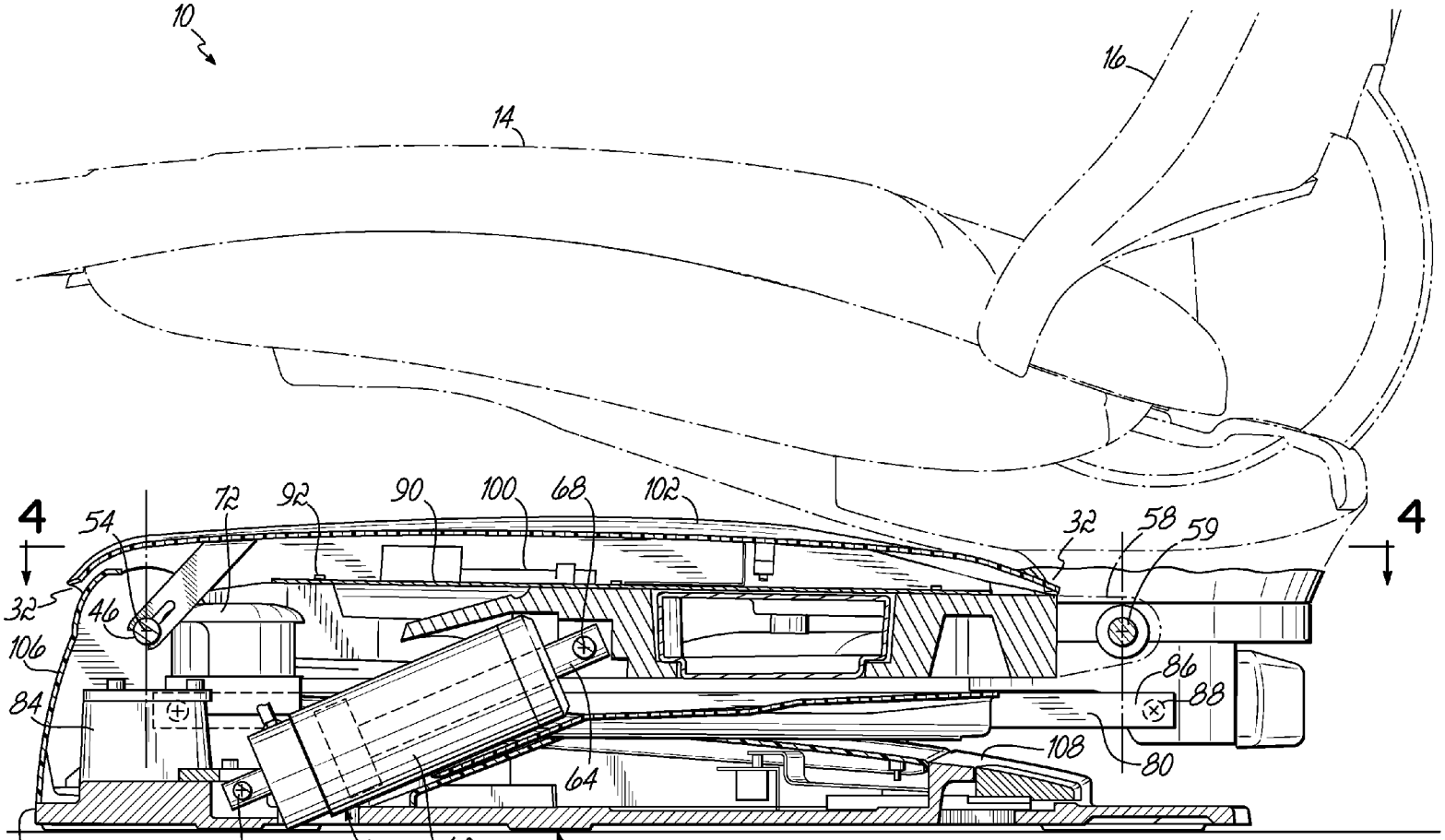
FIG. 3B is a partial cross-sectional view of the dental chair of FIG. 1, in a lowered position.
Figure 4:
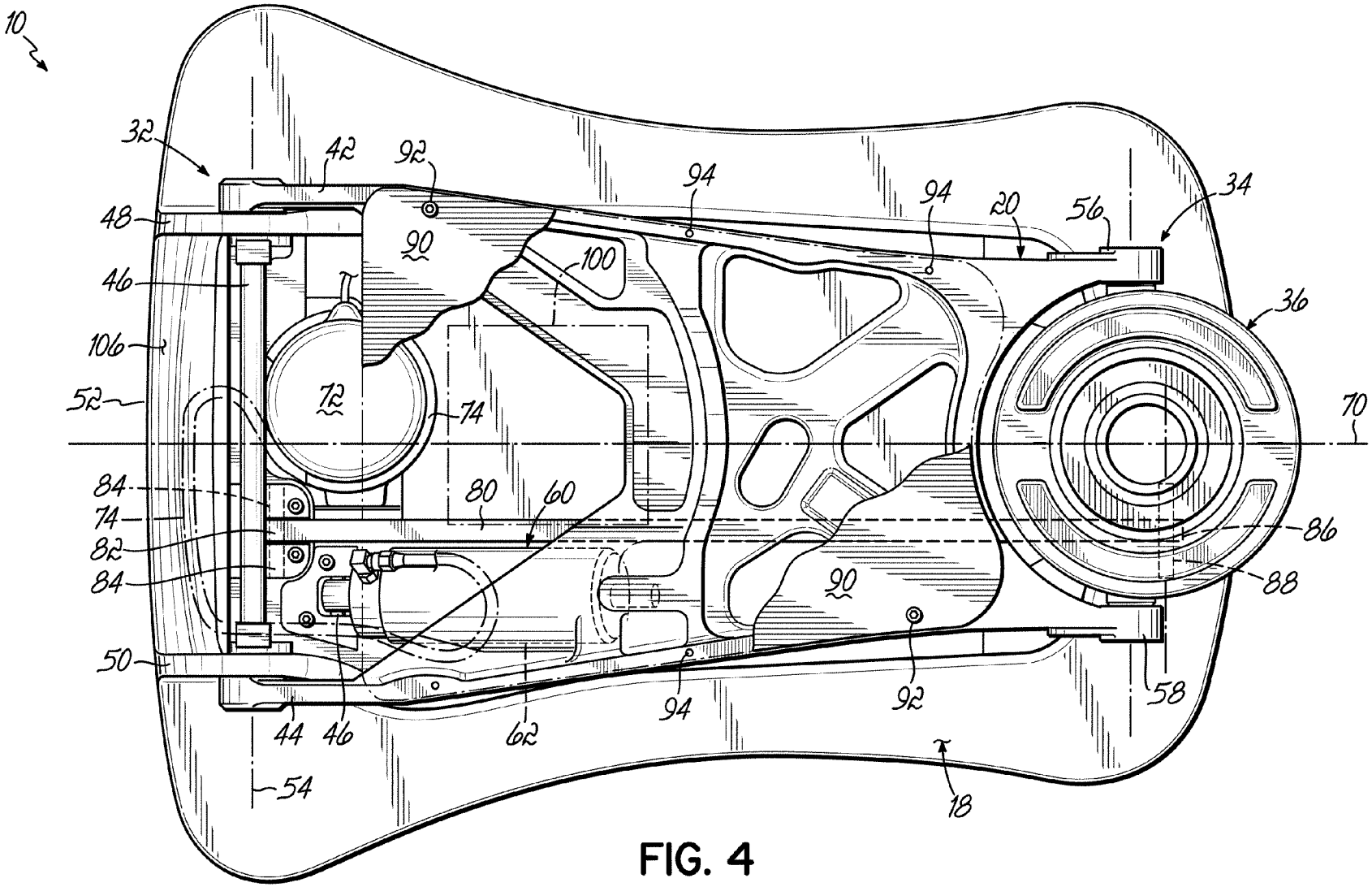
FIG. 4 is a cross-sectional view of the dental chair of FIG. 3B, taken along line 4-4.
Figure 5:
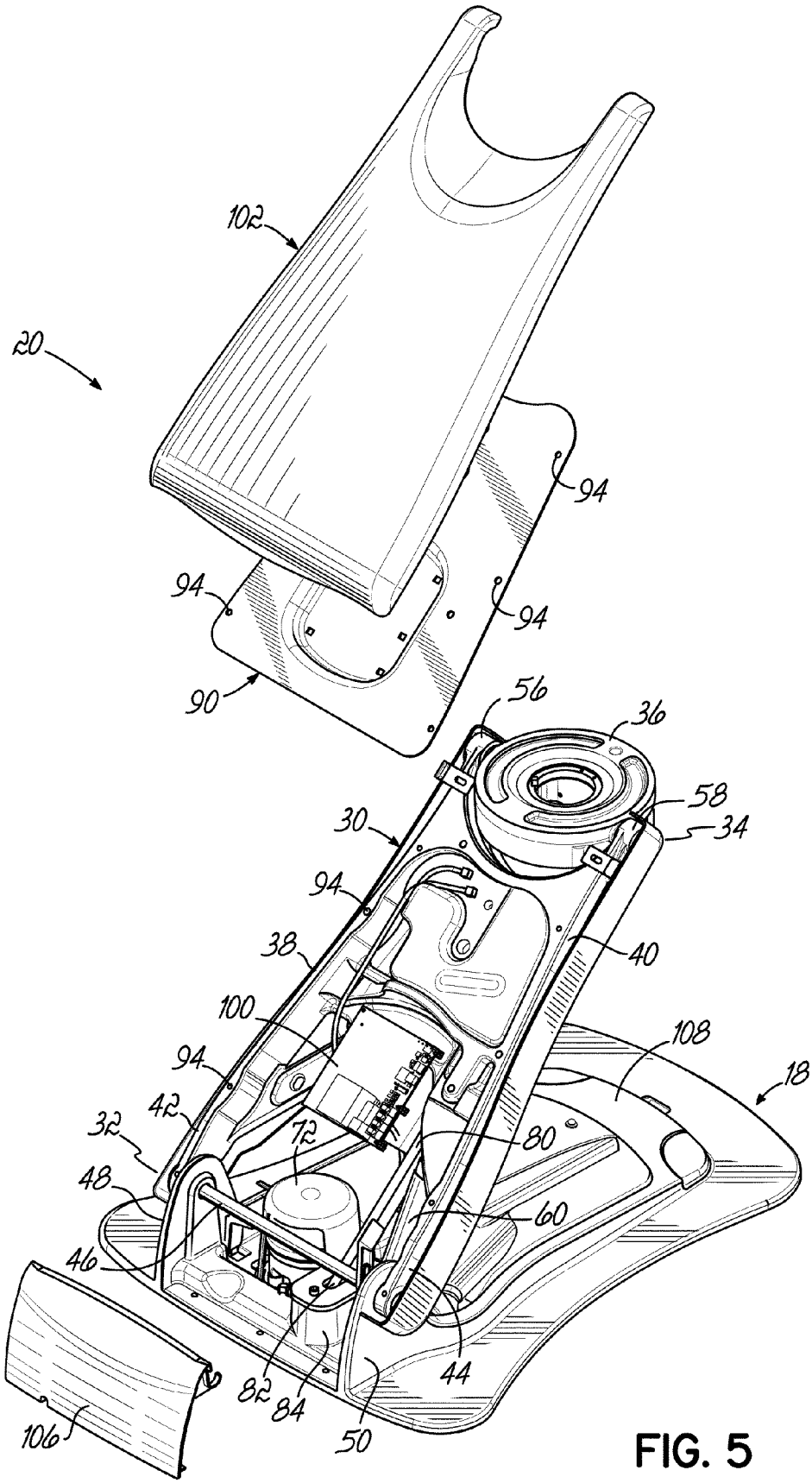
FIG. 5 is a partial exploded view of the dental chair of FIG. 1.

With continued reference to FIG. 2A, and referring further to FIGS. 3A, 3B, 4, and 5, the lift assembly 20 comprises a lift arm 30 having a first end 32 pivotally coupled to the base 18, and a second end 34 pivotally coupled to a seat mount assembly 36. The patient support 12 is operatively coupled to the seat mount assembly 36 for movement with the lift arm 30. With particular reference to FIG. 5, the lift arm 30 of the embodiment shown comprises a frame having first and second side members 38, 40 extending longitudinally between the first and second ends 32, 34 of the lift arm 30. The lift arm 30 may further include horizontal or diagonal cross members, or other structure, between the first and second side members 38, 40 to provide strength and rigidity to the frame. In the embodiment shown, the lift arm 30 is formed as a casting. It will be appreciated, however, that the lift arm 30 may alternatively be machined, welded, forged, or formed by various other methods or combinations of methods.

At the first end 32 of the lift arm 30, the first and second side members 38, 40 define respective first and second clevis arms 42, 44 for securing the first end 32 of the lift arm 30 to an axle 46 supported on the base 18. First and second spaced apart flanges 48, 50 extend generally vertically upwardly from the first end 52 of the base 18 to form support structure for the axle 46. The axle 46 supported by the first and second flanges 48, 50 defines a pivot axis 54 for the lift arm 30 about the first end 52 of the base 18. Similarly, the first and second side members 38, 40 of the lift arm 30 define first and second clevis members 56, 58 at the second end 34 of the lift arm 30 for pivotally supporting the seat mount assembly 36. In the embodiment shown, the first and second clevis members 56, 58 are coupled to trunnions 59 extending from opposite sides of the seat mount assembly 36. As the lift arm 30 is pivoted about the axle 46 to raise and lower the patient support 12, the seat mount assembly 36 may pivot about the second end 34 of the lift arm 30 to maintain the seat section 14 and the back section 16 in a desired orientation relative to horizontal.

Because the pivot axis 54 of the lift arm 30 is located at the first end 52 of the base 18, components of the dental chair 10 for raising and lowering the lift arm 30, or otherwise controlling operation of the dental chair 10, are located behind the pivot axis 54 instead of being positioned forward of the pivot axis 54 as is typical of conventional dental chairs. This configuration provides a compact construction that reduces the overall footprint of the base 18 while allowing for a generally longer lift arm 30 compared to conventional dental chairs. The longer lift arm 30 provides a greater vertical rise of the patient support 12 while minimizing fore and aft movement of the patient support 12 during raising and lowering.

Referring to FIGS. 3A, 3B, and 4, the lift assembly 20 further includes an actuator 60 coupled between the base 18 and the lift arm 30 to facilitate moving the lift arm 30 about the pivot axis 54, thereby raising and lowering the patient support 12. In the embodiment shown, the actuator 60 comprises a hydraulic cylinder including a housing 62 and a piston rod 64 extendable from the housing 62. The housing 62 is pivotally coupled to the base 18 and the distal end of the rod 64 is pivotally coupled to the lift arm 30 by respective pin connections 66, 68, whereby the lift arm 30 is moved from a lowered position, depicted in FIG. 3B, to a raised position, depicted in FIG. 3A, as the piston rod 64 is actuated to extend from the housing 62. To achieve a compact configuration of the dental chair 10, the actuator 60 is positioned relative to the base 18 and the lift arm 30 at a location offset from a longitudinal centerline 70 of the lift arm 30 and in a direction toward the second side member 40 of the lift arm 30, as depicted in FIG. 4.

The dental chair 10 further includes a pump 72 operatively coupled to the actuator 60 by a hydraulic line 74 and appropriate fittings. The pump 72 is operable to provide pressurized fluid to the hydraulic cylinder so that the piston rod 64 is moved in and out of the housing 62 to raise and lower the lift arm 30, as described above. As depicted in FIGS. 4 and 5, the pump 72 is positioned on the base 18 at a location between the first and second side members 38, 40 of the lift arm 30 and behind the axle 46.

While the actuator 60 of the lift assembly 20 has been shown and described herein as a hydraulic cylinder moved by pressurized fluid from a pump 72, it will be appreciated that the actuator may alternatively comprise a pneumatic cylinder, an electric motor, or various other linear or rotary actuators suitable for moving the lift arm about the pivot axis.

The lift assembly 20 further includes a generally elongate linkage member 80 coupled between the base 18 and the seat mount assembly 36 at the second end 34 of the lift arm 30. In the embodiment shown, the first end 82 of the linkage member 80 is pinned to a boss 84 on the base 18 and positioned between the first and second flanges 48, 50. A second end 86 of the linkage member 80 is pivotally coupled to the seat mount assembly 36 by a pin 88 spaced from the pivotal connection between the seat mount assembly 36 and the first and second clevis members 56, 58 at the second end 34 of the lift arm 30. The lift arm 30 and linkage member 80 therefore define a linkage assembly, together with the seat mount assembly 36 and the base 18, whereby the orientation of the seat mount assembly 36 is controlled as the lift arm 30 is moved from the lowered position, depicted in FIG. 3B, to the raised positioned, depicted in FIG. 3A. The linkage member 30 also facilitates supporting the load of the patient support 12 on the second end 36 of the lift arm 30. The weight of the patient support 12, including a patient supported on the patient support 12, tends to unevenly load the second end 34 of the lift arm 30 as a result of the actuator 60 being offset from the longitudinal centerline 70 of the lift arm 30. This uneven loading tends to deflect the first side member 38 of the lift arm 30 more than the second side member 40 of the lift arm 30.

To accommodate the uneven loading of the lift arm 30, the lift assembly 20 further includes a load bearing panel 90, or skin, secured to the lift arm 30. In the embodiment shown, the panel 90 comprises 0.120-inch thick steel sheet secured to the lift arm 30 by bolts 92 installed into threaded apertures 94 in the lift arm 30. It will be recognized that panel 90 may alternatively be secured to lift arm 30 by other methods. As a non-limiting example, one or more bolts 92 may be replaced by dowel pins (not shown) extending from the lift arm 30 and adapted to engage corresponding apertures in the panel 90. The connection of the panel 90 to the lift arm 30 provides a monocoque construction whereby the panel 90 is loaded to resist twisting of the lift arm 30 under the weight of the chair.

The dental chair 10 may further include a control 100 mounted to the lift arm 30. In the embodiment shown, the control 100 is positioned centrally between the first and second side members 38, 40, although it will be appreciated that the control may alternatively be mounted at various other locations on the lift arm 30, or at various locations on the dental chair 10. The control 100 is operatively coupled to the pump 72 and the actuator 60 and is configured to control operation of the dental chair 10 as described herein. The lift assembly 20 may further include front and back cover panels 102, 104 over the lift arm 30, and cover panels 106, 108 on the base 18 to conceal the components of the dental chair 10 and to provide an aesthetically pleasing appearance.

While the present invention has been illustrated by the description of exemplary embodiments thereof, and while the embodiments have been described in considerable detail, they are not intended to restrict or in any way limit the scope of the appended claims to such detail. Additional advantages and modifications will readily appear to those skilled in the art. The various features disclosed herein may be used alone or in any desired combination. The invention in its broader aspects is therefore not limited to the specific details, representative apparatus and method and illustrative examples shown and described. Accordingly, departures may be made from such details without departing from the scope or spirit of the general inventive concept.

What is claimed is:

1. An examination and treatment chair, comprising:

a patient support including a seat and a back;

a base adapted to engage a floor surface, said base having a first terminal end;

a support structure at said first terminal end of said base and extending vertically from said base, said support structure defining a pivot axis proximate said first terminal end;

a lift arm having a first end pivotally coupled to said support structure for rotation about said pivot axis, and a second end coupled to said patient support;

wherein said lift arm comprises a frame having first and second lateral sides spaced from a longitudinal centerline of said lift arm;

an actuator having a first end connected to said base and having a second end connected to said lift arm, said actuator operable to move said lift arm for rotation about said pivot axis;

said actuator offset from said longitudinal centerline in a direction toward one of said first and second lateral sides;

wherein said actuator is a hydraulic cylinder; and a pump in fluid communication with said hydraulic cylinder;

said pump mounted on said base and positioned behind said pivot axis in a direction away from said first terminal end of said base.

2. The examination and treatment chair of claim 1, further comprising:

a linkage member between said base and said patient support;

said linkage member positioned between said actuator and said longitudinal centerline of said lift arm.

3. An examination and treatment chair, comprising:

a patient support including a seat and a back;

a base adapted to engage a floor surface, said base having a first terminal end;

a support structure at said first terminal end of said base and extending vertically from said base, said support structure defining a pivot axis proximate said first terminal end;

a lift arm having a first end pivotally coupled to said support structure for rotation about said pivot axis, and a second end coupled to said patient support;

wherein said lift arm comprises a frame having first and second lateral sides spaced from a longitudinal centerline of said lift arm, and including strengthening structure extending from said first lateral side to said second lateral side;

an actuator coupled between said base and said lift arm and operable to move said lift arm for rotation about said pivot axis;

said actuator offset from said longitudinal centerline in a direction toward one of said first and second lateral sides; and a load bearing panel coupled to said lift arm and fastened at least proximate said first and second sides, said load bearing panel resisting twisting of said lift arm when loaded;

a pump in fluid communication with said actuator; said pump mounted on said base and positioned behind said pivot axis in a direction away from said first terminal end of said base.

4. The examination and treatment chair of claim 1, further comprising:

a single, fixed-length linkage member between said base and said patient support.

* * * * *